US011160323B2

(12) United States Patent
Sanders et al.

(10) Patent No.: US 11,160,323 B2
(45) Date of Patent: Nov. 2, 2021

(54) VISOR CARRIER ASSEMBLY

(71) Applicant: JSP LIMITED, Witney (GB)

(72) Inventors: Stephen Sanders, Witney (GB); Jack Wyld, Witney (GB); Clive Johnstone, Witney (GB)

(73) Assignee: JSP LIMITED, Witney (GB)

( * ) Notice: Subject to any disclaimer, the term of this patent is extended or adjusted under 35 U.S.C. 154(b) by 0 days.

(21) Appl. No.: 17/285,626

(22) PCT Filed: Oct. 4, 2019

(86) PCT No.: PCT/GB2019/052813

§ 371 (c)(1),
(2) Date: Apr. 15, 2021

(87) PCT Pub. No.: WO2020/079397

PCT Pub. Date: Apr. 23, 2020

(65) Prior Publication Data

US 2021/0307448 A1 Oct. 7, 2021

(30) Foreign Application Priority Data

Oct. 16, 2018 (GB) ..... 1816840
Sep. 25, 2019 (GB) ..... 1913836

(51) Int. Cl.
*A42B 3/22* (2006.01)
*A42B 1/0188* (2021.01)

(52) U.S. Cl.
CPC ..... *A42B 3/223* (2013.01); *A42B 1/0188* (2021.01); *A42B 3/225* (2013.01)

(58) Field of Classification Search
CPC ..... A42B 3/223; A42B 1/0188; A42B 3/225
See application file for complete search history.

(56) References Cited

U.S. PATENT DOCUMENTS 2,410,256 A 10/1946 Anderson
4,224,694 A * 9/1980 Palmaer ..... A42B 3/166 2/422

(Continued)

FOREIGN PATENT DOCUMENTS

EP 2628402 A1 8/2013
GB 1523990 A 9/1978
WO 2017167689 A1 10/2017

OTHER PUBLICATIONS

Tasco Woodsman—https://www.forestry-suppliers.com/product_pages/products.php?mi=14721&itemnum=24468.

(Continued)

*Primary Examiner* — Khaled Annis
(74) *Attorney, Agent, or Firm* — Stites & Harbison, PLLC; Patrick M. Torre

(57) ABSTRACT

A visor carrier assembly for a safety helmet includes a double-pivot mechanism attachable to each side of a safety helmet and configured to enable a visor to be selectively pivoted. An elongate arm of the double-pivot mechanism includes first and second pivotal couplings, each including a coupling member being a fixed elongate pin having rounded portions at each end, and a coupling region including an aperture defining, along its inner edge, a first notch or aperture within which one of the rounded portions of a respective coupling member is received to define a fixed pivot point, and an arcuate guide wall with which the opposite rounded portion of said respective coupling member engages and having ridges defining grooves or notches for receiving the opposite rounded portion as a respective pivotal coupling is pivoted about the fixed pivot point, each groove or notch defining a respective said visor position.

6 Claims, 13 Drawing Sheets

(56) References Cited

U.S. PATENT DOCUMENTS

| | | | | | |
|---|---|---|---|---|---|
| 4,312,078 | A * | 1/1982 | Pollitt | A42B 3/222 | 16/348 |
| 4,479,738 | A * | 10/1984 | Kubnick | A42B 3/04 | 2/10 |
| 4,907,300 | A * | 3/1990 | Dampney | A42B 3/228 | 2/424 |
| 5,012,525 | A | 5/1991 | Kuhbauch | | |
| 5,177,816 | A * | 1/1993 | Schmidt | A42B 3/221 | 2/424 |
| 5,239,703 | A * | 8/1993 | Nordin | A42B 3/22 | 2/10 |
| 5,257,417 | A | 11/1993 | Oleson | | |
| 6,047,409 | A * | 4/2000 | Simpson | A42B 3/223 | 2/424 |
| 2009/0038057 | A1* | 2/2009 | Tews | A42B 3/24 | 2/424 |
| 2010/0223707 | A1* | 9/2010 | Moyses | A42B 3/225 | 2/8.2 |
| 2012/0284906 | A1* | 11/2012 | Kuo | A42B 3/223 | 2/424 |
| 2013/0031693 | A1 | 2/2013 | Gleason et al. | | |
| 2018/0213877 | A1* | 8/2018 | Liao | A42B 3/205 | |
| 2018/0242679 | A1* | 8/2018 | Johnstone | A42B 3/288 | |
| 2020/0113268 | A1* | 4/2020 | Liao | A42B 3/326 | |
| 2020/0146387 | A1* | 5/2020 | Nimura | A42B 3/326 | |
| 2020/0383417 | A1* | 12/2020 | Bohn | A42B 3/225 | |
| 2021/0137202 | A1* | 5/2021 | Greene | F16C 11/0604 | |

OTHER PUBLICATIONS

ERB 5001 Face Shield Carrier—https://www.fullsource.com/erb-safety-15162/.

JSP Surefit Visor Carrier for EVO helmets: https://www.jsp.co.uk/link/en/head-protection/hard-hat-accessories/surefit-visor-carrier-for-evo-helmets/anv000-001-108/p/?parm=CAT1JSP&prdcod=ANV000-001-108.

* cited by examiner

VISOR CARRIER ASSEMBLY

FIELD OF THE INVENTION

This invention relates generally to a visor carrier assembly for a safety helmet.

BACKGROUND OF THE INVENTION

Operatives working in potentially hazardous environments, such as construction sites and the like, are required by statute in most jurisdictions worldwide to wear a safety helmet or "hard hat" to prevent severe head trauma in the event of an accident. Numerous different types of such safety helmets are widely known and extensively used throughout various industries.

For some activities, where there is a risk of facial injury or where eye protection is required, an operative may wear a safety helmet assembly comprising a helmet shell and a transparent visor mounted on the helmet shell so as to be selectively movable between a raised/stowed position and a lowered operable position over the user's eyes and face.

Many different such visor-equipped helmet assemblies are known and widely used. For example, in its simplest form, opposing pivot pins may be mounted on respective sides of a helmet shell and engage with opposing side edges of a visor such that it can be pivoted up and down, about a horizontal axis, as required.

However, simply pivoting the visor up and down is considered undesirable because the stowed configuration disrupts the balance of the helmet, and may be uncomfortable, especially for prolonged use. In addition, it is becoming increasingly desirable to provide a removable visor carrier that can be fitted to a standard safety helmet, such that the same helmet can be used for multiple purposes.

US Patent Publication No. 2013/0031693 describes a so-called dual-pivot face shield or visor assembly. The dual-pivot assembly is configured to allow a user to adjust the visor relative to the helmet between three positions. In a first position, the visor is fully down and over a user's face. The configuration of the assembly is such that, in this position, the visor is angled inwardly from the upper brim to the lower edge. Whilst this may contribute to the facial protection provided, it can also be detrimental to the user's ability to see properly through the visor. Ideally, in the operable position, the visor should be substantially at right angles to the user's eye-line to optimise its optical performance.

In order to move the visor to the second position, they need to lift the visor relative to the helmet, causing it to pivot about a first horizontal axis, thereby moving it up and over the crown of the helmet shell. In this position, the visor can be temporarily stowed, where short periods of time between use and non-use is envisaged. However, in this position, the visor position changes the centre of gravity of the assembly, which can be detrimental to the balance of the overall helmet assembly and cause discomfort to the user. Finally, for longer term 'storage', the user can pull the visor forward (from the above-referenced second position) such that it is caused, by the double-pivot mechanism, to pivot about a second horizontal axis located rearwardly of the first horizontal axis (relative to the helmet), and in a direction opposite to the first pivoting action, so as to lower the visor closer to the crown of the helmet and, thereby reducing the centre of gravity and perceived weight, improving balance and, thereby, comfort to the user.

However, the proposed assembly is bulky, with several moving parts and potential points of wear, weakness and failure. The elasticated strap, which secures the visor assembly to the helmet for use, is unsightly and can be difficult to fit. Furthermore, the strap is susceptible to wear.

U.S. Pat. No. 5,012,528 describes a visor attachment for use in combination with a conventional safety helmet wherein the visor is pivotally mounted at the back of the helmet; when used, such helmet is thus worn front-to-back. The attachment body has two side extensions which are adapted to fit into rim slots usually provided in opposite sides of a conventional helmet. These extensions each include a manually releasable connecting member which engages the slot, allowing the visor attachment to be removed from the helmet.

EP Patent Publication No. 2628402 discloses a movement device for a helmet for moving a first element of the helmet with respect to a second element of the helmet. The movement device includes a pivot element for pivoting the first element of the helmet with respect to the second element of the helmet about an axis of rotation, and a pivot seat, in which the pivot element is arranged. The pivot element includes an eccentric portion or cam, and said seat includes a first seat region adapted to receive said eccentric portion and a second seat region adapted to receive said eccentric portion. The first seat region is in a position angularly offset and linearly translated with respect to said second seat region. A first position of the pivot element corresponds to said first seat region and a second position of the pivot element corresponds to a second seat region, such that, when the eccentric portion of the pivot element passes from the first seat region to the second seat region, the pivot element performs both a rotation in order to compensate for angular offsetting between the second seat region and the first seat region and a translation to compensate for linear offsetting between the second seat region and the first seat region.

GB Patent No. 1523990 discloses a plastic face shield that is secured to a frame of a helmet by means of a cam that is rotatably mounted on the frame. The cam projects into an elongated slot in the shield and the dimensions of the cam are such that its maximum length is slightly greater than the minor dimension of the slot.

There is an ongoing desire to improve visor carrier assemblies, and the present invention seeks to address one or more of the above-mentioned issues.

SUMMARY OF THE INVENTION

In accordance with an aspect of the present invention, there is provided a visor carrier assembly for a safety helmet, comprising: a visor; and an attachment device for attaching the visor to a safety helmet for use, the attachment device including a double-pivot mechanism attachable to each side of a safety helmet and configured to enable the visor to be selectively pivoted relative to said safety helmet, in use, between at least first, second and third visor positions, each double-pivot mechanism comprising an elongate arm, said elongate arm being coupled, by a first pivotal coupling at one end thereof, to a respective side region of the visor and coupled, by a second pivotal coupling at a longitudinally opposing second end thereof, to a fixed point, in use, at a respective side of said safety helmet, each pivotal coupling comprising a coupling member and a coupling region, each coupling member comprising a fixed elongate pin having rounded portions at each end, each coupling region comprising an aperture defining, along its inner edge, a first notch or aperture within which one of the rounded portions of a respective coupling member is received to define a fixed pivot point, and an arcuate guide wall with which the opposite rounded portion of said respective coupling member engages and having a plurality of ridges defining grooves or notches for receiving said opposite rounded portion as a respective pivotal coupling is pivoted about said fixed pivot point, each said groove or notch defining a respective said visor position.

There are numerous advantages associated with various aspects of the present invention. Firstly, because the configuration of the double-pivot mechanism allows attachment thereof to the side of the helmet, the centre of gravity is improved, compared with prior art arrangements, thereby improving balance and comfort. The double-pivot mechanism can be connected directly to the visor, eliminating the need for a separate visor carrier element and, thereby, reducing the weight (and cost) of the assembly, in comparison to prior art arrangements. The double pivot mechanism can comprise a second elongate arm configured to be fixedly mounted at a respective side edge of a safety helmet for use, wherein a said coupling region is provided in or on the second elongate arm. The coupling region can be provided integrally with the second elongate arm, beneficially at an end thereof. The first pivotal coupling can be located toward the front of the safety helmet relative to the second pivotal coupling, in use.

No spring loaded struts, or other relatively complex components are required, which reduces the points of wear and potential failure, as well as reducing weight. Indeed, the configuration of the double-pivot mechanism is such that the weight and bulk of the assembly is minimised. Still further, the configuration of the double pivot mechanism enables accessories, such as ear defenders, to be used in conjunction therewith, and also stowed over the crown of the helmet shell, without interference from the visor carrier assembly.

The two pivotal coupling can be substantially horizontally aligned relative to the helmet, when oriented for use, in at least a first visor position in which said visor is fully deployed over a user's face. In prior art arrangements, the coupling between the mechanism and the visor tends to be below the brim of the helmet when in the fully lowered position, which introduces a point of weakness and can also be a hazard, especially if it protrudes significantly from the side of the visor.

In accordance with another aspect of the present invention, there is provided a visor carrier assembly for a safety helmet, comprising a visor and an attachment device for attaching the visor to a safety helmet for use, the attachment device comprising a double-pivot mechanism attachable to each side of a safety helmet and configured to enable the visor to be selectively pivoted about first and second respective axes relative to the safety helmet between a fully lowered position, in which the visor is fully deployed and over a user's face and a fully stowed position, in which the visor is raised relative to the user's face and stowed substantially parallel to the crown of the safety helmet, each double pivot mechanism comprising a pair of pivotal couplings, said pivotal couplings being substantially horizontally aligned above the respective adjacent side edge of the safety helmet, in use, when the visor is in said fully lowered position.

These and other aspects of the present invention will be apparent from the following detailed description.

DETAILED DESCRIPTION

In the preceding and following description, directional descriptors such as upper, lower, inner, outer, vertical, horizontal, etc. are used to describe the invention when in the preferred orientation. It will be understood that the orientation can change during use, and therefore the corresponding descriptors will change.

Figure 1:
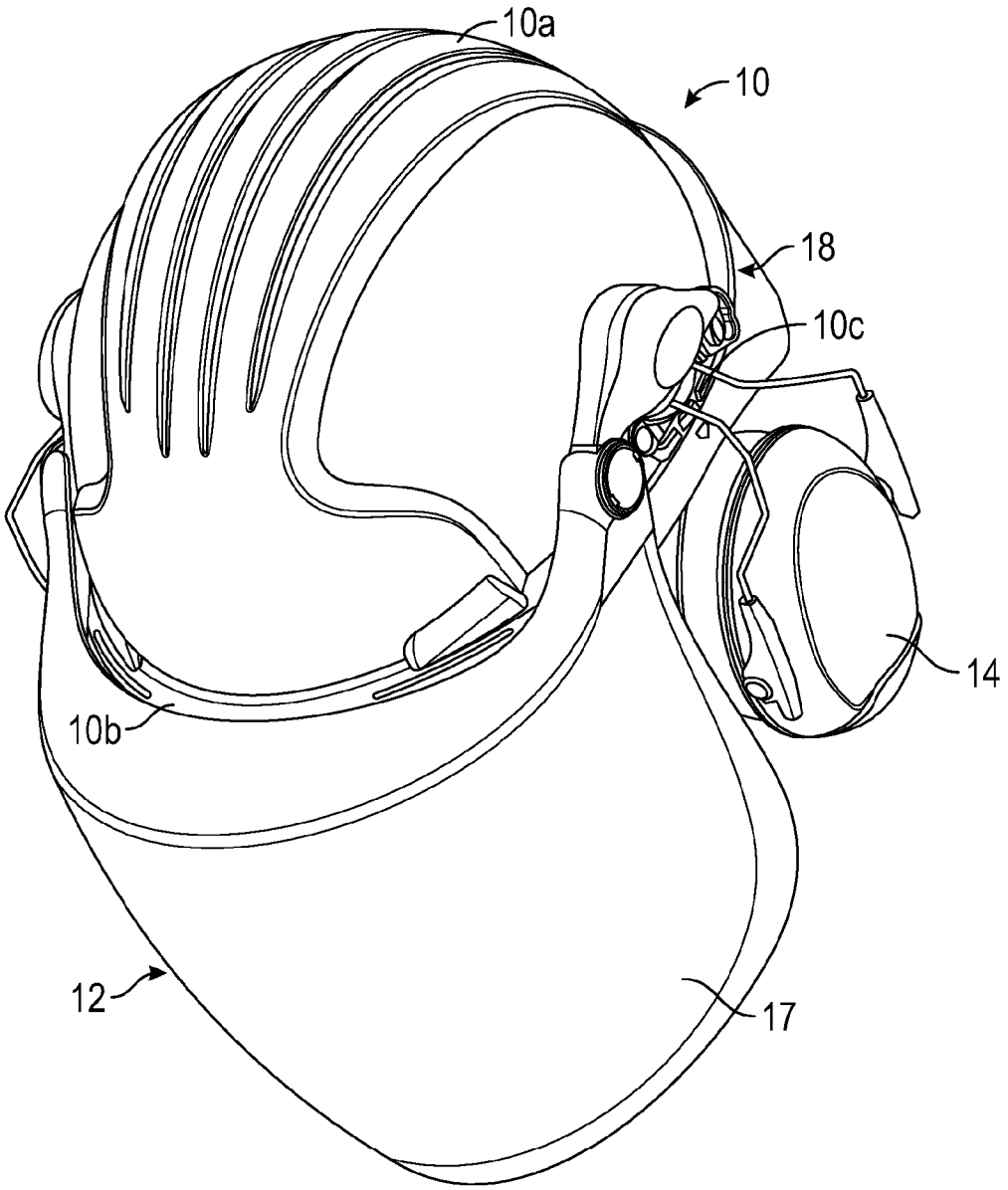
FIG. 1 is a perspective view of a safety helmet assembly including a visor carrier assembly, wherein the visor is in a fully lowered position.
Figure 2:
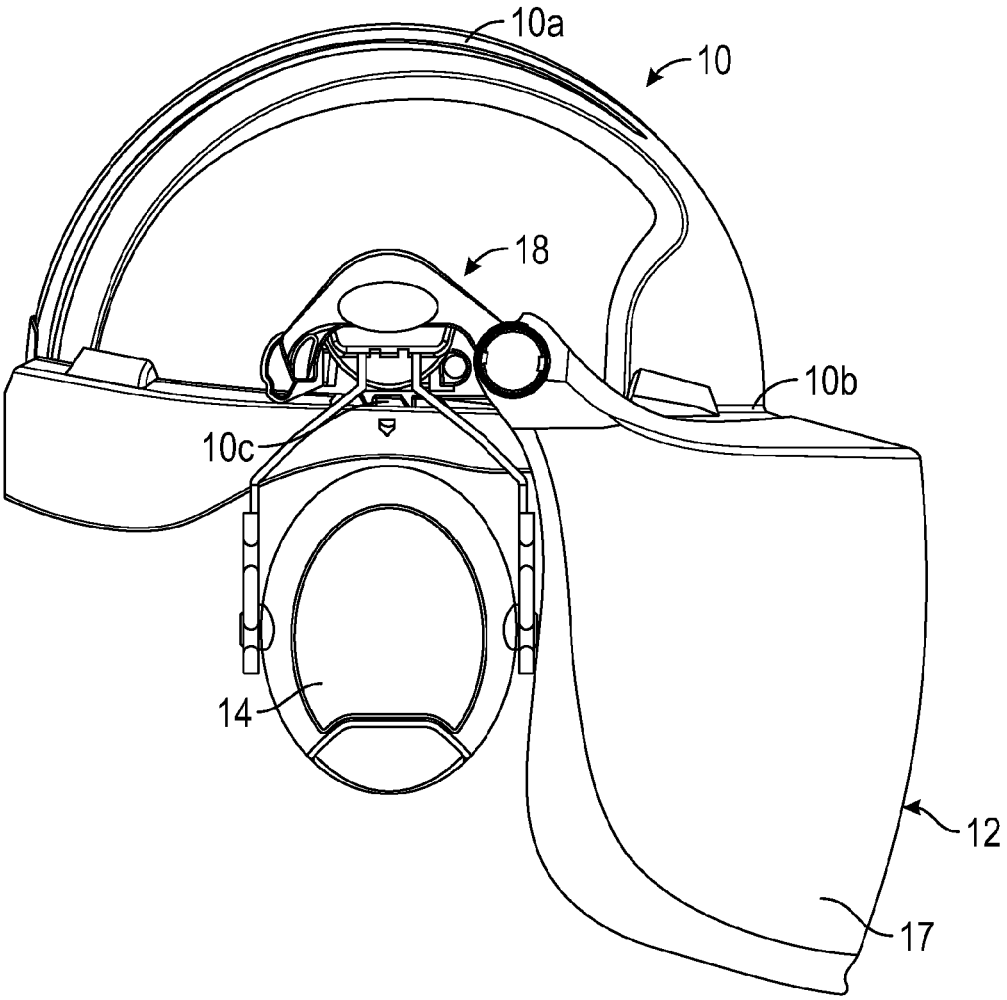
FIG. 2 is a side view of the safety helmet assembly of FIG. 1.

Referring to FIGS. 1 and 2 of the drawings, a safety helmet 10 is illustrated, on which a visor carrier assembly 12 is mounted. The safety helmet 10 can comprise any known configuration and can be formed of a hard outer shell 10*a* which is generally dome shaped so as to fit over the head of a user when worn, and the rim is generally oval in shape. The shell can be constructed of plastic materials typical of such safety helmets although it will be appreciated that the shell 10 can be constructed of any suitable material as will be apparent to those skilled in the art and the present invention is not necessarily intended to be limited in this regard. The safety helmet 10 further comprises an integral brim 10*b* that extends around the front edge of the shell 10*a*. A universal slot 10*c* is provided on opposing side edges of the shell 10*a* to receive further protective equipment, such as ear defenders 14.

The visor carrier assembly 12 comprises a transparent visor 17, in the form of a faceshield, and an attachment device 18 for attaching the visor 17 to the safety helmet 10 for use. The faceshield is formed of a curved piece of transparent material substantially large enough to protect the wearer from flying particulates and debris which might otherwise strike the wearer's face and cause injury or irritation. FIGS. 1 and 2 illustrate the faceshield in the operable position, wherein the faceshield extends downwardly from the brim 10*b* of the safety helmet 10 and effectively covers the user's face during use. In the operable position, the faceshield 17 is angled or oriented so that the part of the faceshield adjacent the wearer's eyes is substantially perpendicular to the wearer's eyeline. The faceshield 17 is curved along its lateral axis, so that the faceshield 17 protects the side of the wearers face during use.

Figure 3:
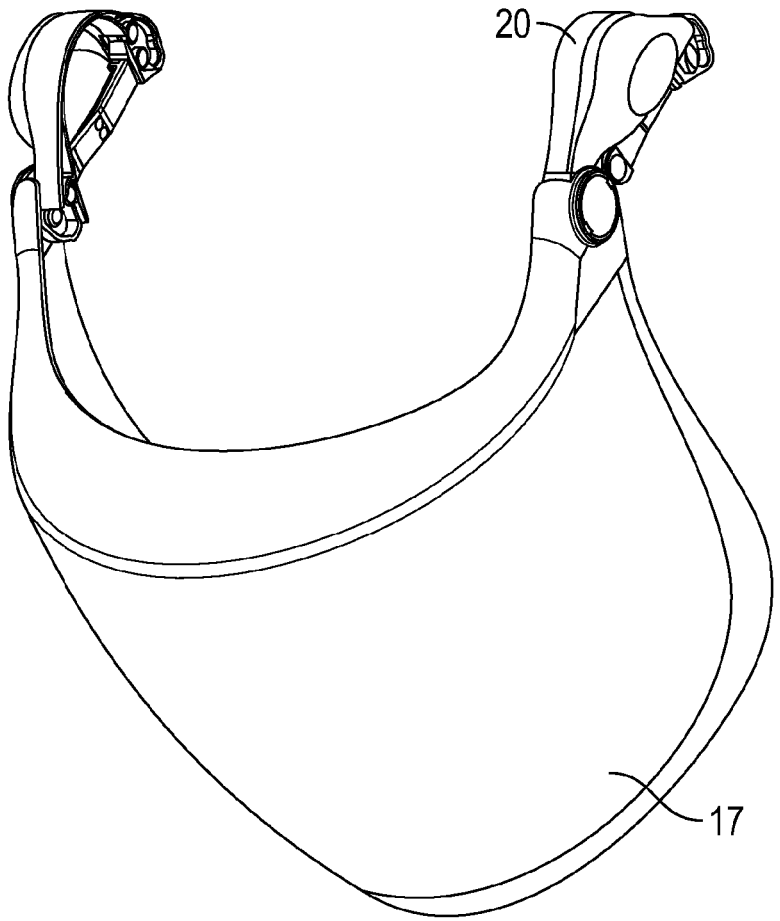
FIG. 3 is a perspective view of the visor carrier assembly of FIG. 1.
Figure 4:
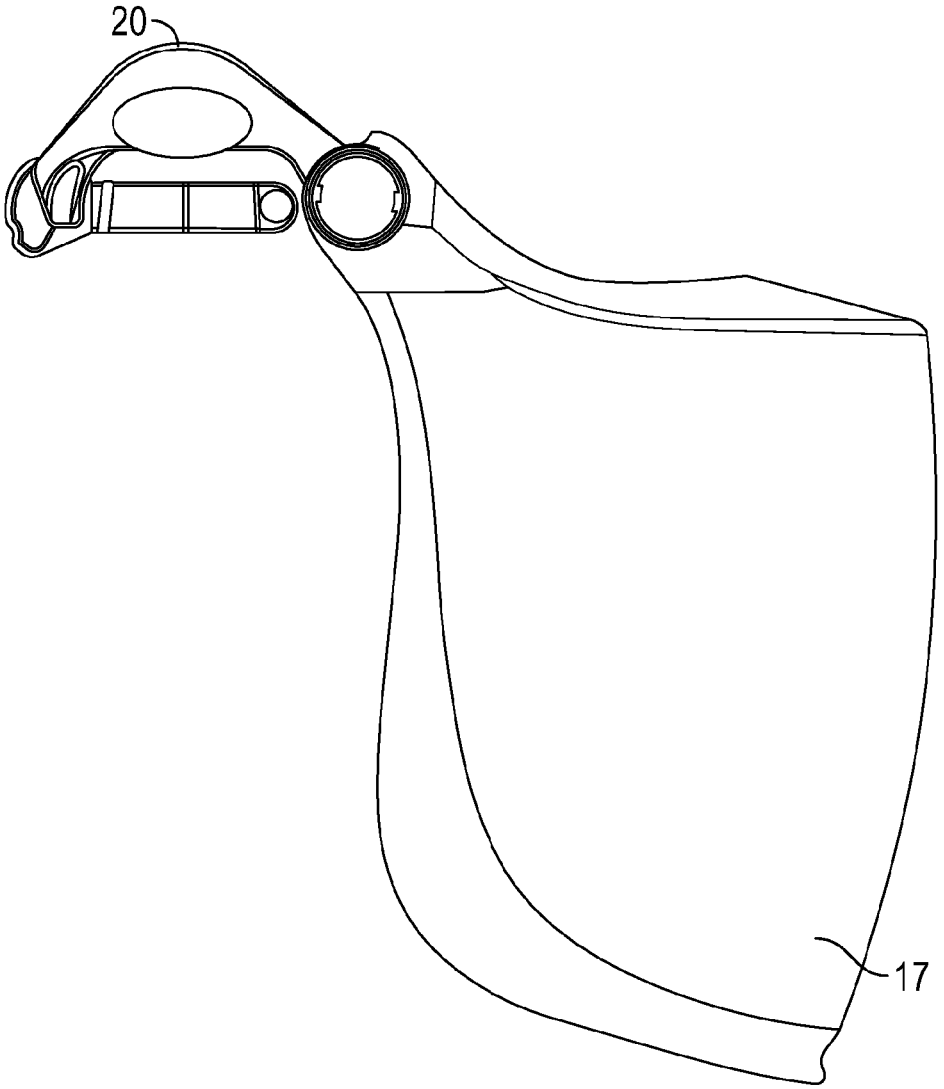
FIG. 4 is a side view of the visor carrier assembly of FIG. 3.
Figure 5:
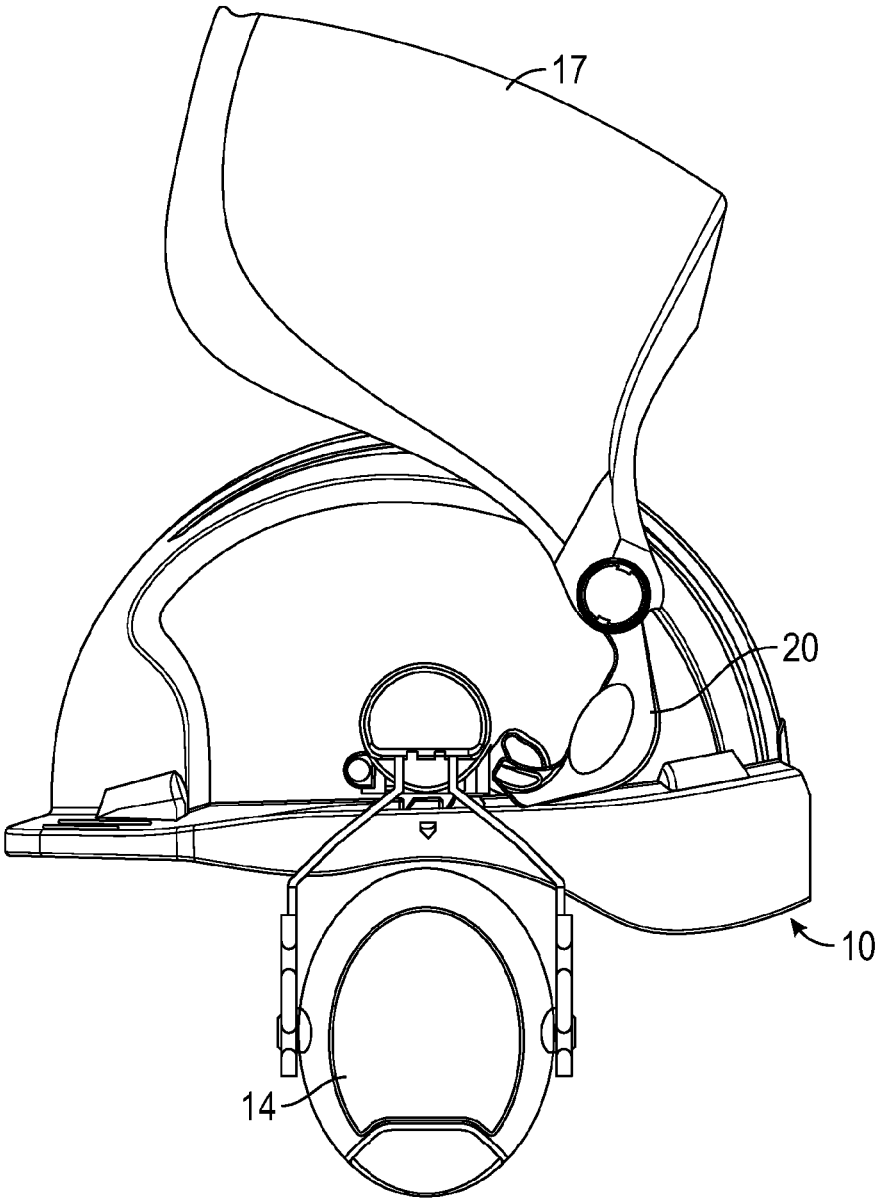
FIG. 5 is a side view of the safety helmet and visor carrier assembly of FIG. 1, with the visor in the fully raised position.
Figure 6:
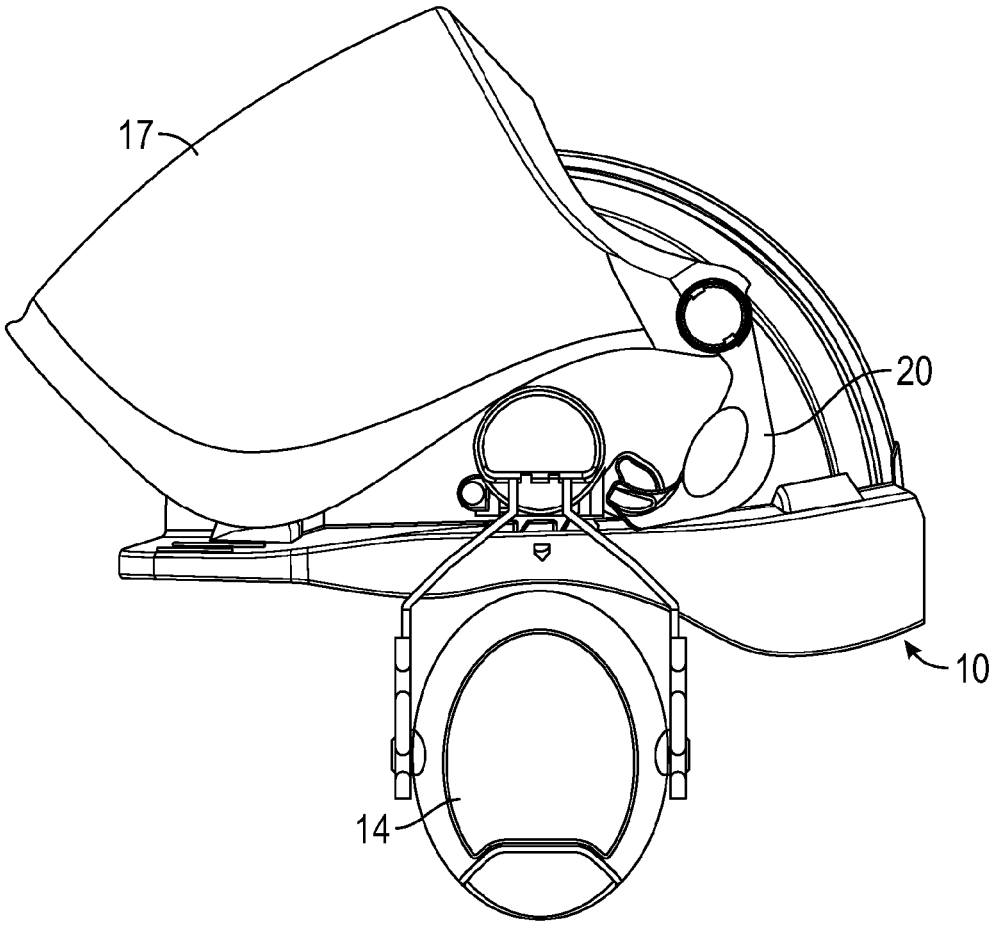
FIG. 6 is a side view of the safety helmet and visor carrier assembly of FIG. 1, with the visor in the fully stowed and locked position.

Referring additionally to FIGS. 3 and 4 of the drawings, the attachment device comprises a double pivot mechanism 20, attached or otherwise provided on each side of the visor 17, at its upper edge when oriented for use. The term, 'double pivot mechanism' refers to a mechanism that allows the visor to be pivoted about two separate but parallel horizontal axes. More specifically, it enables the visor 17 to be pivoted about a first axis, upward, away from the user's face and over the top of the safety helmet 10 (see FIG. 5), and then about a second axis, downward and toward the helmet shell 10*a* so that it can be stowed close to the top of the helmet (as illustrated in FIG. 6), without significantly affecting the centre of gravity and balance of the helmet/visor carrier assembly.

Figure 7:
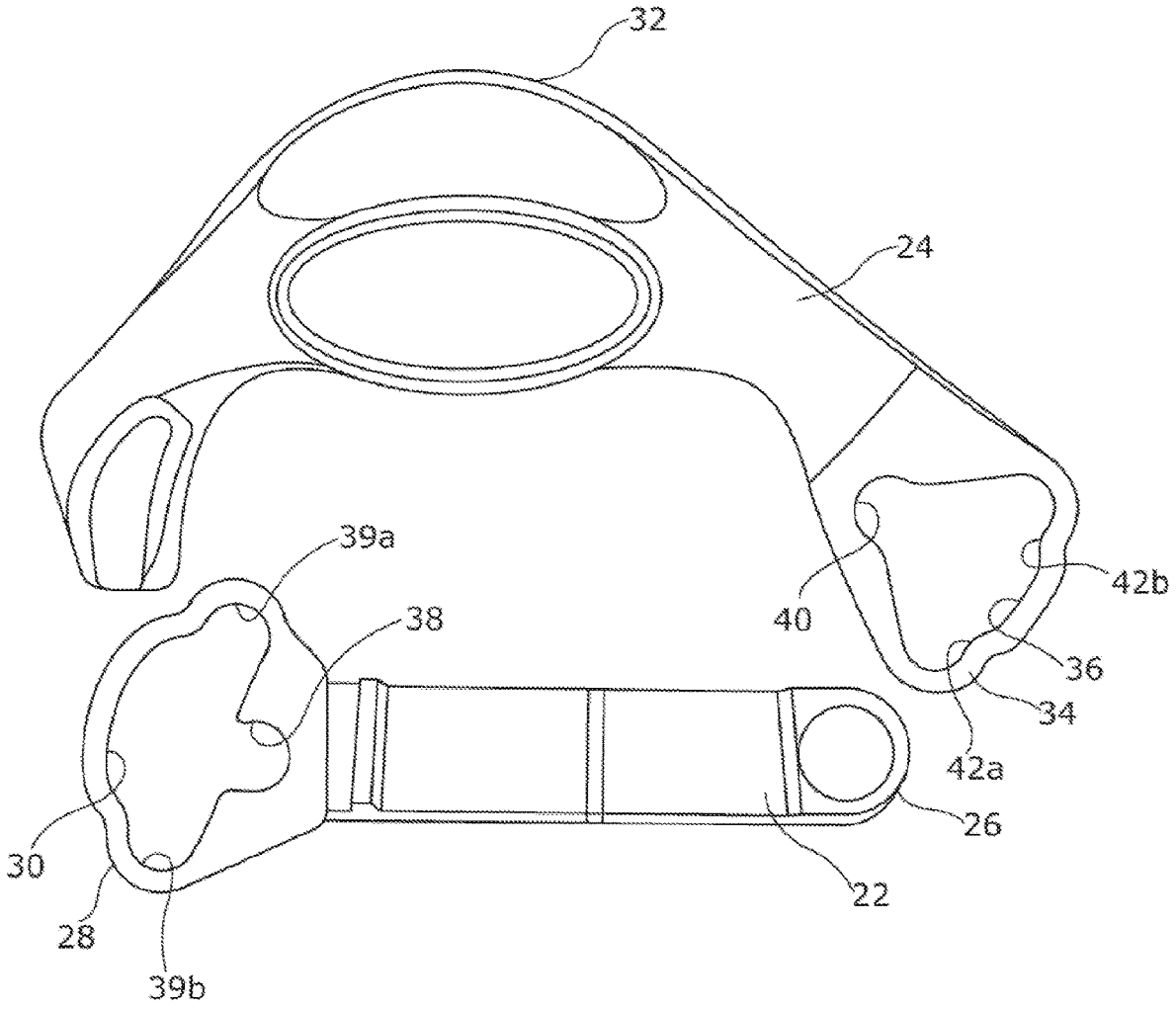
FIG. 7 is a front view of the first and second elongate arms of a double pivot mechanism included in a visor carrier assembly.

Referring now to FIG. 7, each double pivot mechanism 20 comprises a first elongate arm 22 and a second elongate arm 24. The first elongate arm 22 is generally linear along its length and has a rounded first end 26. The longitudinally opposing second end terminates in a wider coupling region 28 defining a profiled aperture 30.

The second elongate arm 24 is generally arcuate along its length having a concave recess or 'cap' 32 at one end. The longitudinally opposing other end terminates in a coupling region 34 defining a profiled aperture 36. The first and second elongate arms 22, 24 can be formed of any suitable material, such as hard plastic or rubber, and the present invention is not intended to be in any way limited in this regard.

The inner edge of each coupling region 28, 34 of a double pivot mechanism 20 (i.e. the profiled edge of the respective aperture 30, 36 nearest the main body of the respective elongate arm 22, 24) defines a respective notch 38, 40. Referring to the coupling region 28 of the first elongate arm 22, the profiled edge of the aperture 30 opposite the notch 38, defines two laterally spaced apart rounded notches 39*a*, 39*b* and a generally arcuate wall therebetween. Referring to the coupling region 34 of the second elongate arm 24, the profiled edge of the aperture 36 has two spaced-apart ridges 42*a*, 42*b* and rounded wall sections between the notch 40 and the ridges 42*a*, 42*b* and a generally arcuate wall section between the ridges 42*a*, 42*b*.

Figure 8A:
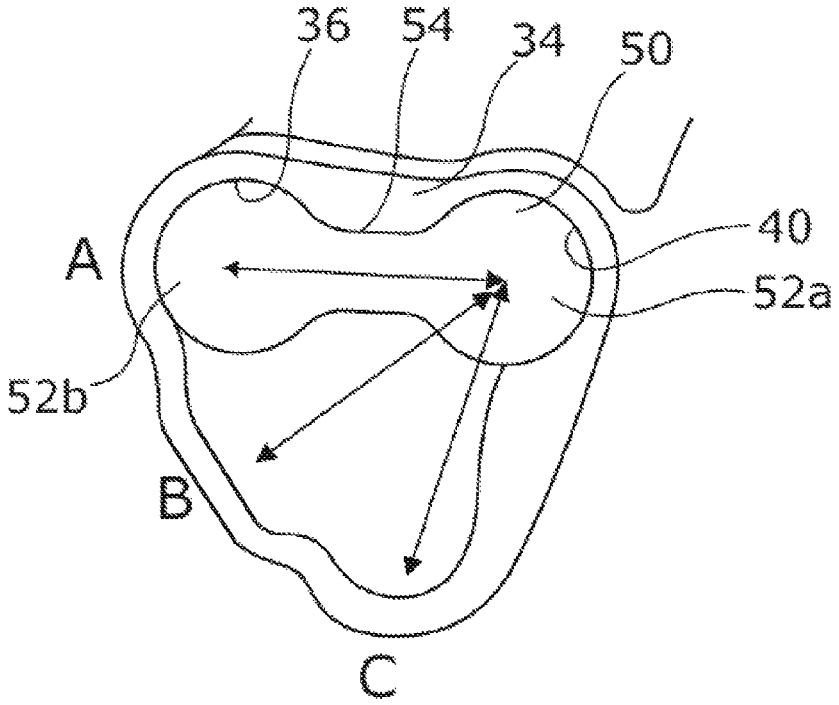
FIG. 8A is a close-up view of the 'front' pivot of a double pivot mechanism included in a visor carrier assembly.
Figure 8B:
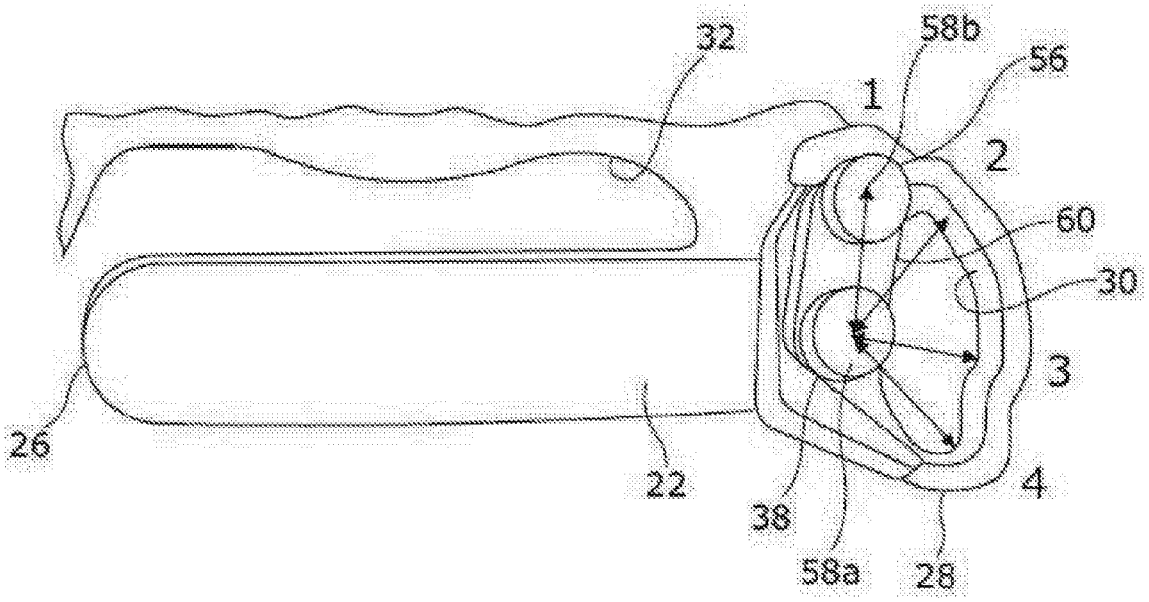
FIG. 8B is a close-up view of the 'rear' pivot of a double pivot mechanism included in a visor carrier assembly.

Referring to FIGS. 8A and 8B of the drawings, the visor 17 is pivotally coupled to the second elongate arm 24 by a coupling peg 50 which is received within the aperture 36 of the coupling region 34 of the second elongate arm 24 (see FIG. 8A). The coupling peg 50 is generally elongate and of a length substantially equal to the distance between the notch 40 and the opposing profiled wall of the aperture. The coupling peg 50 comprises two generally circular locating members 52*a*, 52*b* with an integral short, narrower linear portion 54 therebetween. One of the locating members 52*a* of the coupling peg 50 is received within the notch 40 and defines a first fixed pivot point (i.e. the 'front' pivot point) of the mechanism. The other locating member 52*b* sits against the opposing profiled wall so that, as the mechanism is pivoted about the first fixed pivot point defined by the first locating member 52*a*, the second locating member 52*b* can slide along the profiled wall.

The second elongate arm 24 is pivotally coupled, at the end including the cap 32, to the first elongate arm 22 by a coupling peg 56 which is received in the aperture 30 of the coupling region 28 of the first elongate arm (see FIG. 8B). Once again, the coupling peg 56 is generally elongate and of a length substantially equal to the distance between the notch 38 and the opposing profiled wall of the aperture 30. The coupling peg 56 comprises two generally circular locating members 58*a*, 58*b* with an integral narrower linear portion 60 therebetween. One of the locating members 58*a* is received within the notch 38 and defines a second fixed pivot point of the mechanism. The other locating member 58*b* sits against the opposing profiled wall so that, as the mechanism is pivoted about the second fixed pivot point (i.e. the 'rear' pivot point) defined by the first locating member 58*a*, the second locating member 58*b* can slide along the profiled wall.

Together, the two pivot mechanisms, that define two separate but substantially parallel horizontal pivotal axes, provide a visor carrier assembly with five defined visor positions, as will now be described with reference to FIGS. 9A to 9E and FIGS. 10A to 10E of the drawings. When the visor carrier assembly is mounted on the safety helmet for use, the first elongate arm 22 is fixedly attached on the safety helmet, the second elongate arm 24 is configured to be selectively pivoted relative to the first elongate arm 22 about the rear pivot point, and the visor 17 can be selectively pivoted relative to the second elongate arm 24 (at the opposite end) about the front pivot point, relative thereto in order to move the visor into a selected one of the five defined visor positions.

Figure 9A:
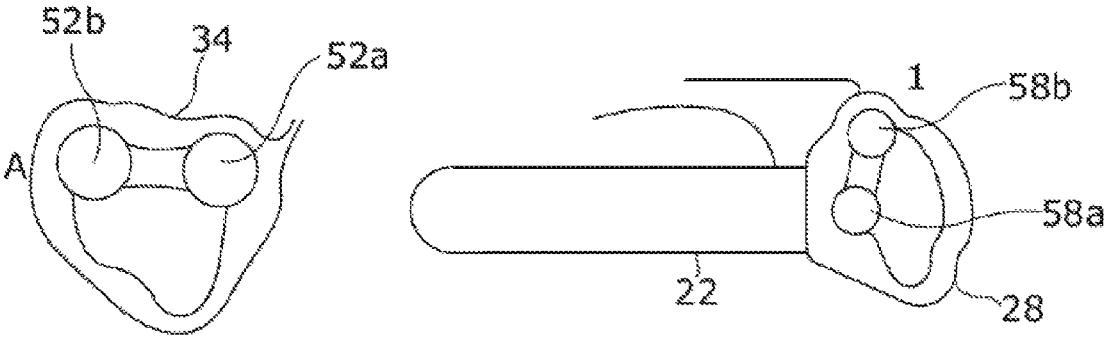
FIGS. 9A to 9E are schematic close-up views of the front and rear pivots of a double pivot mechanism included in a visor carrier assembly, for various respective visor positions.
Figure 10A:
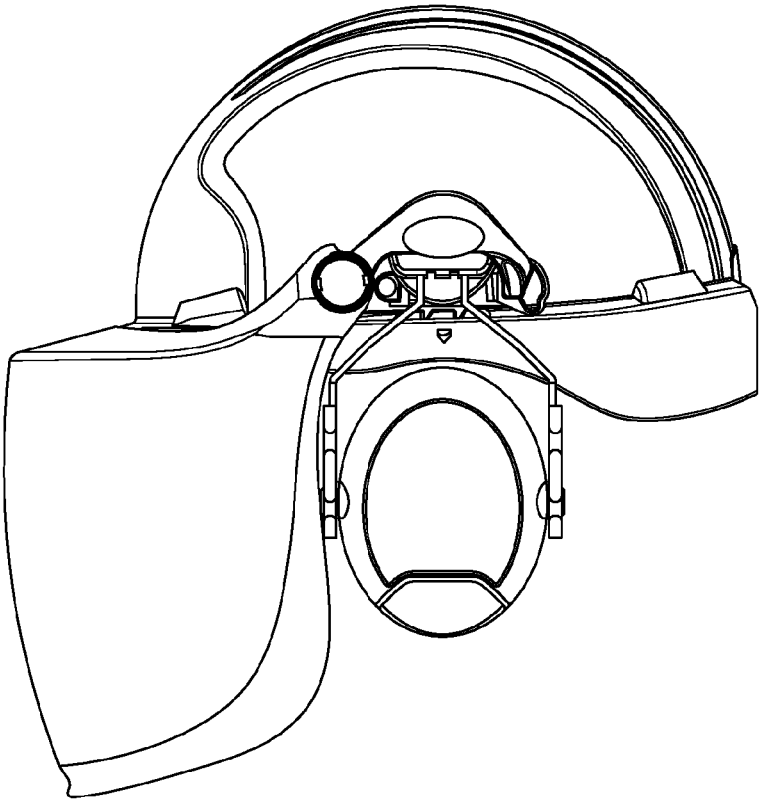
FIGS. 10A to 10E are illustrative of the five respective visor positions provided by a visor carrier assembly.

Referring to FIG. 9A of the drawings, a first visor position is defined when the coupling peg 50 (coupling the visor 17 to the second elongate arm 24 at one end) is in Position A (the locating member 52*b* of the coupling peg 50 is located in the ridge 42*b*) abutting a first side edge (i.e. horizontal/uppermost edge) of the aperture 36 defining the coupling region 34 of the second elongate arm 24, and the second coupling peg 56 (coupling the second elongate arm 24 at the other end—i.e. the end opposing the end of the second elongate arm 24 with the coupling region 34—to the fixed first elongate arm 22) is in Position 1 (the locating member 58*b* of the coupling peg 56 is located in the notch 39*a*) abutting a first side edge (i.e. uppermost edge) of the aperture 30 of the coupling region 28 of the first elongate arm 22. As shown in FIG. 10A, when the double pivot mechanism is in this configuration, in use, the visor 17 is fully down and locked for use. In other words, the visor 17 is in the operable position, described above, when the visor 17 extends downwardly from the brim 10*b* of the safety helmet 10 and effectively covers the user's face during use. In the operable position, the visor 17 is angled or oriented so that the part of the visor 17 adjacent the wearer's eyes is substantially perpendicular to the wearer's eyeline. In this configuration, the coupling peg 50 and the visor 17 can be described as being at an angle of 0° from horizontal.

Figure 9B:
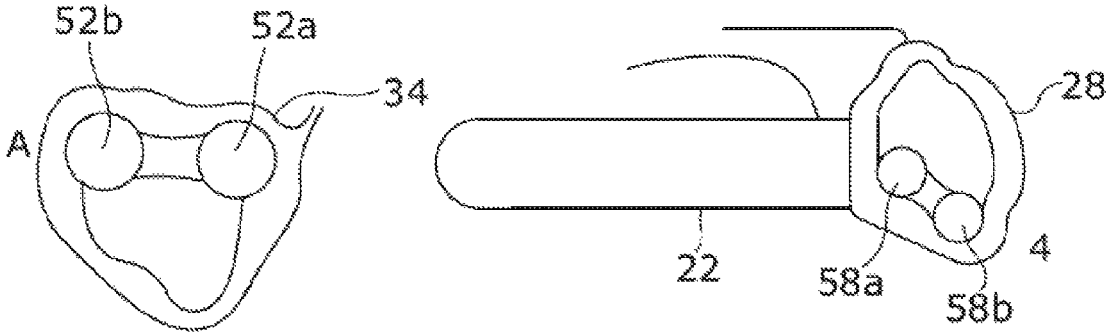

From this configuration, if the visor 17 is pushed upward, away from the user's face, it can pivot about the second (rear) fixed pivot point until the respective coupling peg 56 reaches Position 4 (the locating member 58*b* of the coupling peg 56 is located in the notch 39*b*), having respectively passed Positions 2 and 3 (the locating member 58*b* of the coupling peg 56 is located at the generally arcuate wall section between notches 39*a* and 39*b*), abutting the opposing side wall/edge (i.e. lowermost edge) of the aperture 30 defining the coupling region 28 of the first elongate arm 22. During this process, the other pivotal coupling (i.e. the coupling peg 50) remains stationary in Position A and, when the rear pivot reaches Position 4, the visor 17 is fully up, over the user's head and over the top of the safety helmet 10, as illustrated in FIGS. 9B and 10C. In this configuration, the coupling peg 50 and the visor 17 can be described as being at about an angle of 100° from the operable position, when the visor is fully down and locked for use.

Figure 9C:
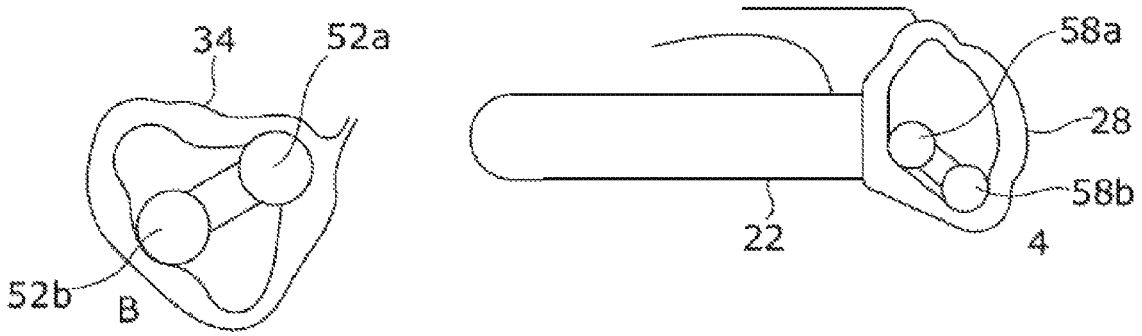
Figure 9D:
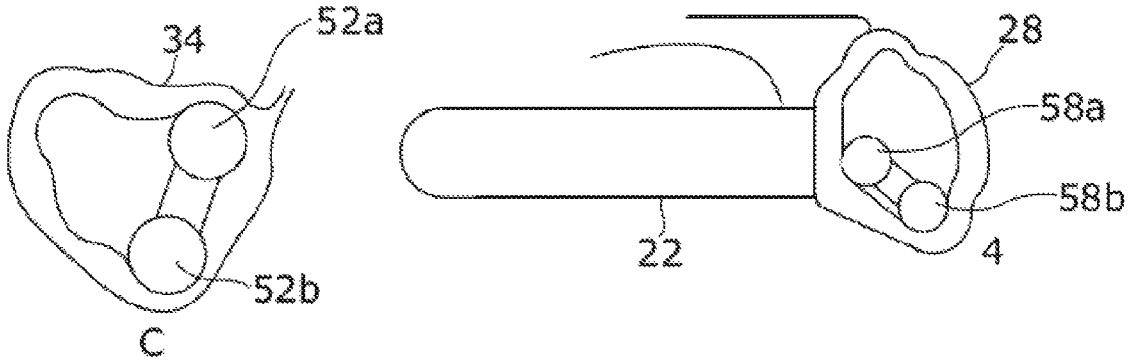
Figure 10B:
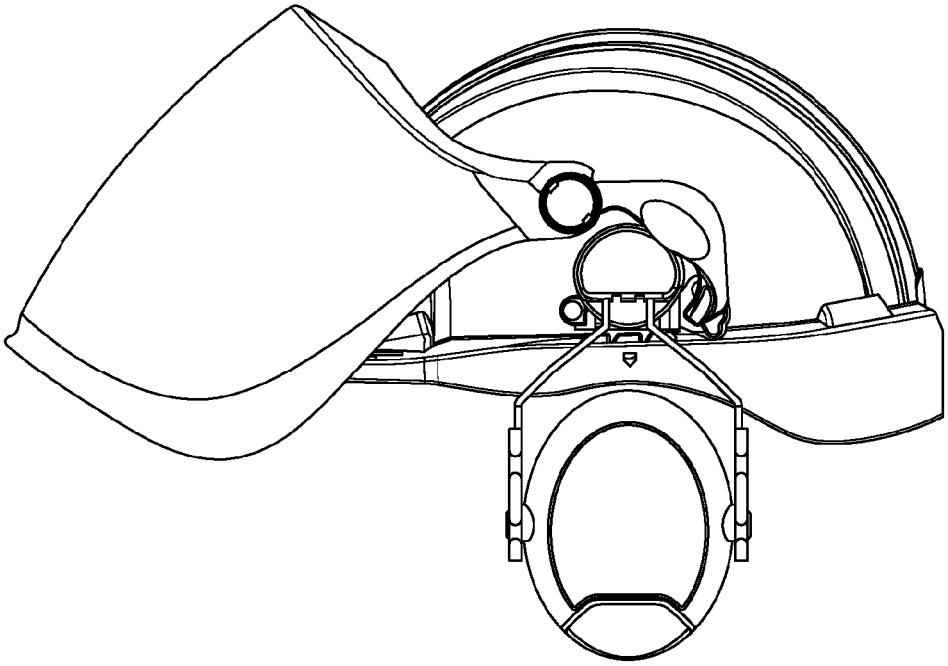
Figure 10C:
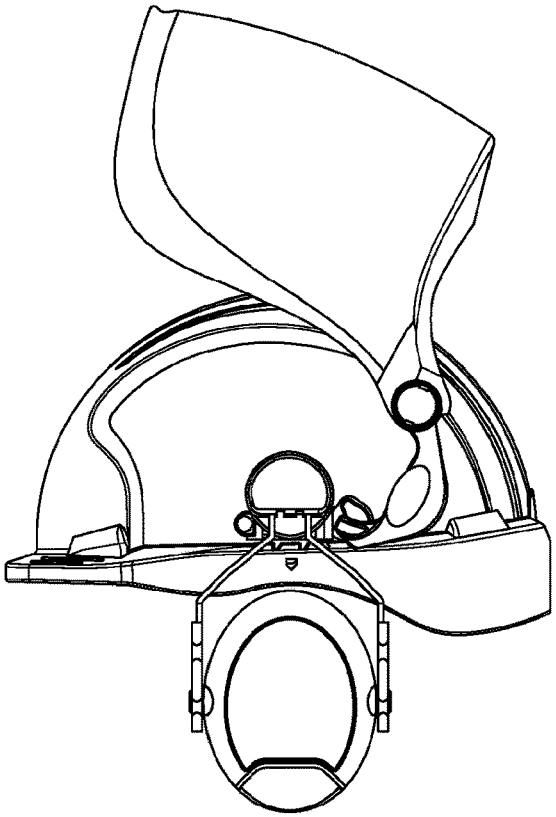
Figure 10D:
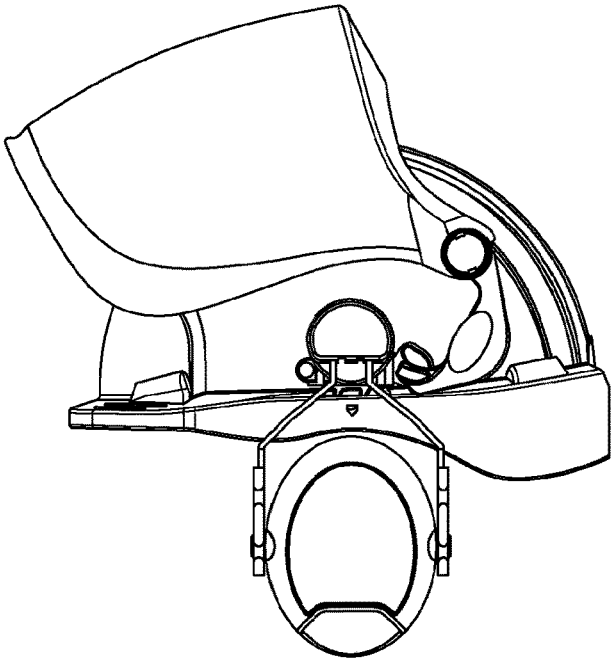
Figure 10E:
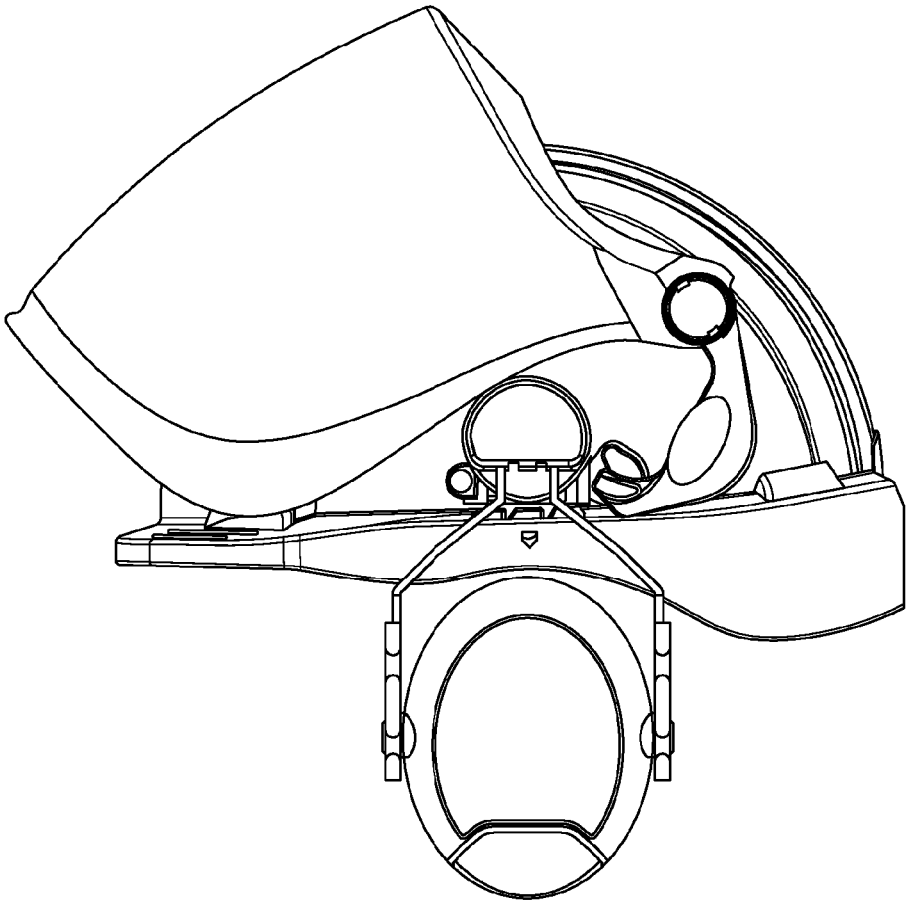

From this configuration, the visor 17 can be pivoted (relative to the second elongate arm 24) about the front pivot (with the rear pivot remaining stationary in Position 4), through Position B of the front pivot (the second locating member 52*b* of the coupling peg 50 is located in the generally arcuate wall section between the ridges 42*a*, 42*b*)—see FIGS. 9C and 10D; to position C (the second locating member 52*b* of the coupling peg 50 is located in ridge 42*a*) with the coupling peg 50 abutting the opposing side wall/edge (i.e. lowermost edge) of the aperture 30 (see FIG. 9D), thereby moving the visor 17 to a fully stowed and locked configuration, as shown in FIG. 10E.

Figure 9E:
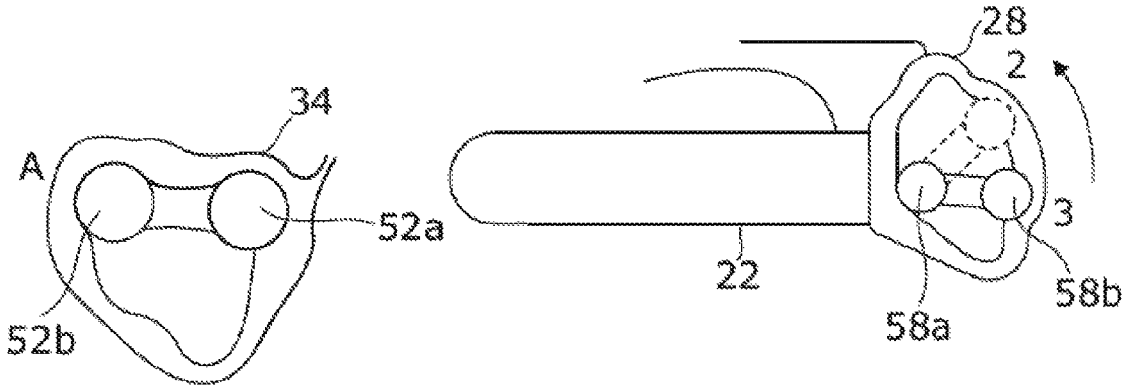

As illustrated by FIG. 10B, the visor 17, when being pivoted down for use, from the fully up position illustrated in FIG. 10C, the front pivot remains stationary at Position A and the rear pivot moves through Position 3 (at which the angle of the visor 17 and the coupling peg 50 is around 30° from the operable position; and the locating member 58*b* is located at the end of the generally arcuate wall section, between notches 39*a* and 39*b*, that is closest to notch 39*b*) to Position 2 (at which the angle of the visor 17 and the coupling peg 50 is around 90° from the operable position; and the locating member 58*b* is located at the end of the generally arcuate wall section, between notches 39*a* and 39*b*, that is closest to notch 39*a*), see FIG. 9E, and, from there, can be moved to Position 1 for use (FIGS. 9A and 10A).

The 'cap' 32 of the second elongate arm 24 arcs over the existing universal slot 10*c* of the safety helmet 10, thus enabling both the visor assembly and other mountable components to be attached to the safety helmet 10 and function independently without compromising the function of the visor assembly and the mountable component. For example, ear defenders 14 can be attached to the safety helmet 10 with the visor assembly, and both can function independently without compromising either element of face and/or ear protection. The ear defenders 14, with their standard universal attachment means, are not interfered with, either in use or, indeed, when not in use, because the pivot mechanism enables ear defenders 14 and the visor 17 to be stored together above the helmet 10.

The lightweight and streamlined arrangement, together with the fact that both pivots remain above the brim of the safety helmet 10 at all times, irrespective of the visor position, results in significantly reduced weight and improved balance and comfort.

The double pivot design enables the visor 17 to be stowed close to the crown of the helmet 10, thus reducing the centre of gravity, perceived weight and improving balance, thus increasing comfort. All of these benefits are provided whilst still providing a useful range of 'locked' visor positions.

Further changes can be made within the scope of this invention.

The invention claimed is:

1. A visor carrier assembly for a safety helmet, comprising:

a visor; and an attachment device for attaching the visor to the safety helmet, the attachment device including double-pivot mechanisms for attachment to each side of the safety helmet to enable the visor to be selectively pivoted relative to the safety helmet, between first, second and third visor positions, wherein each double-pivot mechanism comprises a first elongate arm coupled by a first pivotal coupling at one end to a respective side region of the visor, and coupled by a second pivotal coupling at a second end to a fixed point at a respective side of the safety helmet, wherein each pivotal coupling comprises a coupling member and a coupling region, wherein each coupling member comprises a fixed elongate pin having a rounded portion at each end, wherein each coupling region comprises an aperture defining a first notch or aperture along its inner edge within which one of the rounded portions of a respective coupling member is received to define a fixed pivot point, and an arcuate guide wall with which the opposite rounded portion of said respective coupling member engages and having ridges defining grooves or notches for receiving the opposite rounded portion as a respective pivotal coupling is pivoted about the fixed pivot point, wherein each groove or notch defines a respective visor position and wherein the double pivot mechanism comprises a second elongate arm to be fixedly mounted at a respective side edge of the safety helmet, wherein a coupling region is provided in or on the second elongate arm.

2. The visor carrier assembly according to claim 1, wherein the first elongate arm is directly coupled to the visor by the first pivotal coupling.

3. The visor carrier assembly according to claim 1, wherein a coupling region is provided integrally with the second elongate arm.

4. The visor carrier assembly according to claim 1, wherein a coupling region is provided at one end of the second elongate arm.

5. The visor carrier assembly according to claim 4, wherein the other end of the second elongate arm is configured to be inserted through a recess provided on the safety helmet so as to fixedly mount the visor carrier assembly to the safety helmet.

6. The visor carrier assembly according to claim 1, wherein the two pivotal coupling are substantially horizontally aligned relative to the helmet, when oriented in the first visor position, such that, when worn by a user, the visor is deployed over the user's face.

* * * * *